US009913029B2

(12) United States Patent
Shin

(10) Patent No.: US 9,913,029 B2
(45) Date of Patent: Mar. 6, 2018

(54) SOUND FILTERING SYSTEM

(71) Applicant: Haebora Co., Ltd., Seoul (KR)

(72) Inventor: Doo Sik Shin, Seoul (KR)

(73) Assignee: Haebora Co., Ltd., Seoul (KR)

( * ) Notice: Subject to any disclaimer, the term of this patent is extended or adjusted under 35 U.S.C. 154(b) by 0 days.

(21) Appl. No.: 15/308,607

(22) PCT Filed: May 18, 2016

(86) PCT No.: PCT/KR2016/005267
§ 371 (c)(1),
(2) Date: Nov. 3, 2016

(87) PCT Pub. No.: WO2017/026631
PCT Pub. Date: Feb. 16, 2017

(65) Prior Publication Data

US 2017/0188142 A1 Jun. 29, 2017

(30) Foreign Application Priority Data

Aug. 10, 2015 (KR) ..... 10-2015-0112327

(51) Int. Cl.
*H04R 1/10* (2006.01)
*H04R 3/00* (2006.01)
*H04R 3/04* (2006.01)

(52) U.S. Cl.
CPC ..... *H04R 3/005* (2013.01); *H04R 1/1083* (2013.01); *H04R 3/04* (2013.01); *H04R 2201/107* (2013.01); *H04R 2410/01* (2013.01); *H04R 2460/13* (2013.01)

(58) Field of Classification Search
CPC .. G10L 21/0272; G10L 21/0364; H04M 1/05; H04M 1/19; H04R 1/1083; H04R 2410/00; H04R 2460/00; H04R 3/005
USPC ..... 381/74, 71.1–71.6, 151, 94.1–94.4, 1–3
See application file for complete search history.

(56) References Cited

U.S. PATENT DOCUMENTS

| | | | | |
|---|---|---|---|---|
| 9,232,308 | B2 * | 1/2016 | Murata | H04R 3/00 |
| 9,398,366 | B2 * | 7/2016 | Gleiβner | H04R 1/1083 |
| 2009/0086988 | A1 | 4/2009 | Ou et al. | |
| 2014/0037101 | A1 | 2/2014 | Murata et al. | |

(Continued)

FOREIGN PATENT DOCUMENTS

| | | | |
|---|---|---|---|
| KR | 10-2015-0005924 | 1/2015 | |
| WO | WO 2013/147384 | * 10/2013 | H04R 5/033 |

OTHER PUBLICATIONS

International Search Report and the Written Opinion dated Aug. 18, 2016 From the Korean Intellectual Property Office Re. Application No. PCT/KR2016/005267 and Its Translation of Search Report Into English. (10 Pages).

*Primary Examiner* — Lun-See Lao

(57) ABSTRACT

Provided is an earset. The earset includes an internal microphone provided inside an earphone worn on a user's ear, and configured to receive a first sound transferred from the user's mouth through an external auditory meatus via an Eustachian tube and convert the first sound into a first sound signal, at least one external microphone provided outside the earphone, and configured to receive a second sound provided from the user's mouth and convert the second sound into a second sound signal, and a controller configured to filter a noise of the second sound signal based on the first sound signal, remove the noise, and generate a third sound signal.

4 Claims, 4 Drawing Sheets

(56) References Cited

U.S. PATENT DOCUMENTS

| | | | | |
|---|---|---|---|---|
| 2014/0185819 | A1 | 7/2014 | Gleissner | |
| 2014/0301562 | A1 | 10/2014 | Tu et al. | |
| 2016/0241948 | A1* | 8/2016 | Liu ..... | H04M 1/19 |

* cited by examiner

SOUND FILTERING SYSTEM

RELATED APPLICATIONS

This application is a National Phase of PCT Patent Application No. PCT/KR2016/005267 having International filing date of May 18, 2016, which claims the benefit of priority of Korean Patent Application No. 10-2015-0112327 filed on Aug. 10, 2015. The contents of the above applications are all incorporated by reference as if fully set forth herein in their entirety.

FIELD AND BACKGROUND OF THE INVENTION

The present invention relates to a sound filtering system, and more particularly, to a sound filtering system of an earset in which separate microphones are respectively provided inside and outside an earphone.

Generally, an earset, which is a voice transmission and reception apparatus in which an earphone (or a speaker) and a microphone are combined, is connected to electronic devices such as MPEG audio layer-3 (MP3) players and mobile phones in a wired or wireless manner to transmit or receive a sound, voice, and the like through a user's ears and mouth.

Such an earset is broadly classified as a separable earset in a form in which a speaker for outputting a sound is inserted into a user's ear and a microphone is positioned close to the user's mouth, and as an integrated earset in a form in which all of a speaker and a microphone are inserted into the user's ear.

However, in the case of the separable earset, since a sound provided from a user's mouth is introduced into the earset with an ambient noise, there is a problem in that the sound is inaccurately transferred when a microphone is used in a noisy place.

On the other hand, in the case of the integrated earset, since all of a speaker for outputting a sound signal provided from an external device as a sound and a microphone for receiving a sound signal transferred from a user's mouth through an external auditory meatus via an Eustachian tube are inserted into the user's ear, there is an advantage in that the integrated earset may be used even in a noisy place compared to the separable earset.

However, in the case of the integrated earset, there is a problem in that a quality of a sound transmitted to the microphone embedded in the ear is degraded due to a ringing phenomenon and the like. That is, the ringing of the sound received from the microphone embedded in the ear occurs, a tone and the like is changed or only a low-pitched sound stands out between an original sound output from the user's mouth and a sound transferred from the user's mouth through the external auditory meatus via the Eustachian tube, and thus the other party is difficult to clearly recognize a voice of the user. In some cases, the other party hears a nasal voice of the user and feels displeasure. Therefore, since the sound is unclearly transferred, there is a problem in that the user may not call the other party with a good sound quality.

SUMMARY OF THE INVENTION

The present invention is directed to providing a sound filtering system in which the other party may clearly recognize a voice of a user even in a noisy environment and the user may call the other party with a good sound quality.

One aspect of the present invention provides a sound filtering system including an internal microphone provided inside an earphone worn on a user's ear, and configured to receive a first sound transferred from the user's mouth through an external auditory meatus via an Eustachian tube and convert the first sound into a first sound signal, at least one external microphone provided outside the earphone, and configured to receive a second sound provided from the user's mouth and convert the second sound into a second sound signal, and a controller configured to filter a noise of the second sound signal based on the first sound signal, remove the noise, and generate a third sound signal.

Here, the controller may be provided in an earset including the internal microphone and the at least one external microphone, or in an external device.

The first sound signal and the second sound signal preferably have the same phase.

The system may further include an output adjuster configured to adjust an output of the third sound signal.

The earphone may include a speaker configured to output a sound signal provided from the external device as a sound and provide the sound to the external auditory meatus of the user.

According to the present invention, since an introduced ambient noise of sounds which are directly collected from the user's mouth is filtered and removed based on the sound transferred from the user's mouth through the user's ears and only the filtered voice of the user is then provided to the other party, the other party can clearly recognize the voice of the user even in a noisy environment, the user can call the other party with a good sound quality, and the sound filtering system can also be used in voice commands or voice translation.

DESCRIPTION OF SPECIFIC EMBODIMENTS OF THE INVENTION

Figure 1:
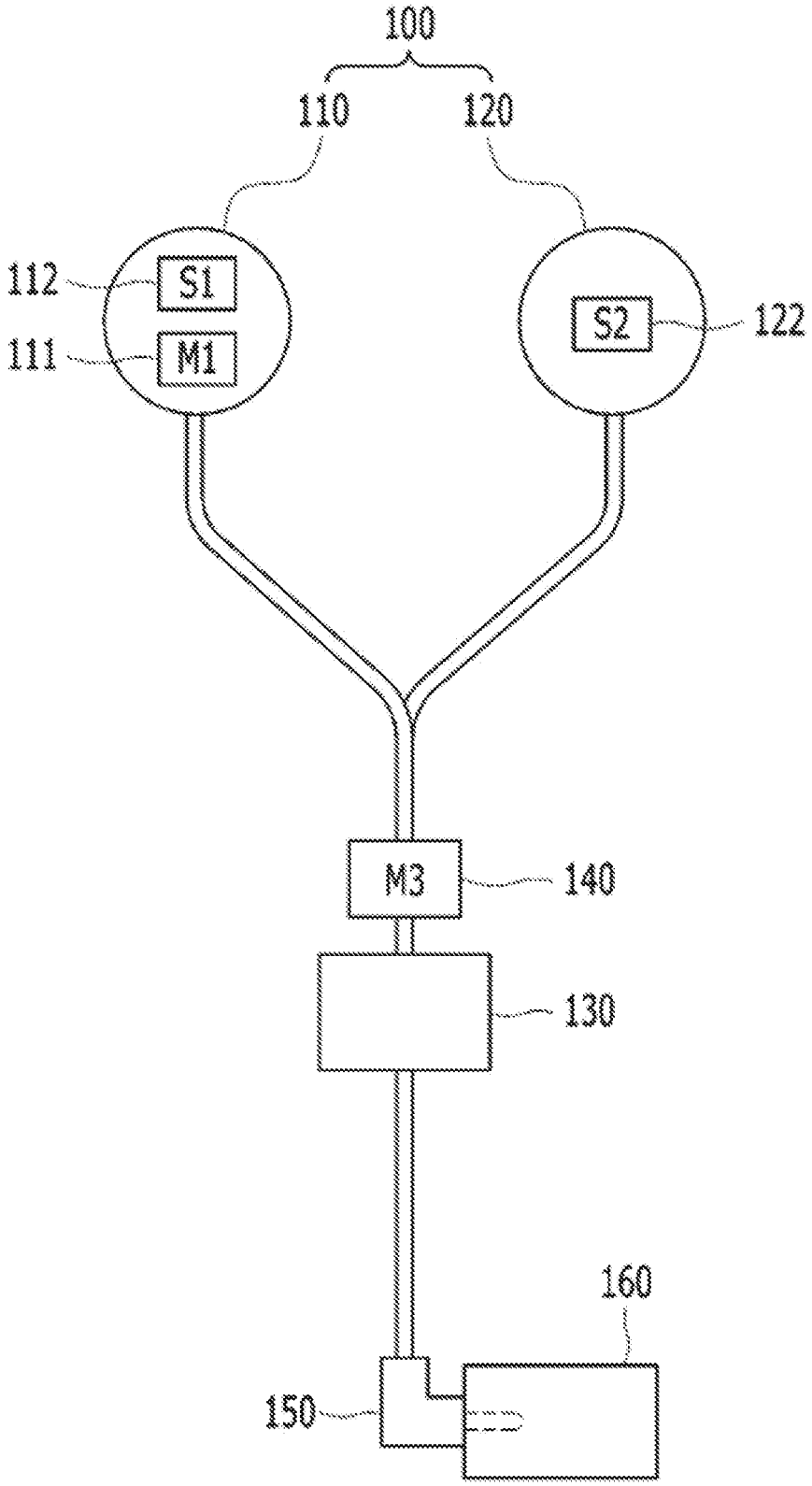
FIG. 1 is a schematic diagram of a sound filtering system according to one embodiment of the present invention.

Hereinafter, the present invention will be described in detail with reference to the accompanying drawings.

Before the present invention is described, like reference numerals in various embodiments denote like elements, one embodiment will be representatively described, and only elements of other embodiments, which are different from those of one embodiment, will be described.

In the following description, an earset to which a sound filtering system is applied refers to a device in which a speaker and a microphone are integrally configured and inserted into an ear, and it is revealed in advance that the earset may be applied to an earphone for listening to music, a wired ear microphone, a Bluetooth headset, a WiFi headset, a near-field communication (NFC) headset, and a binary code division multiple access (CDMA) headset.

Figure 2:
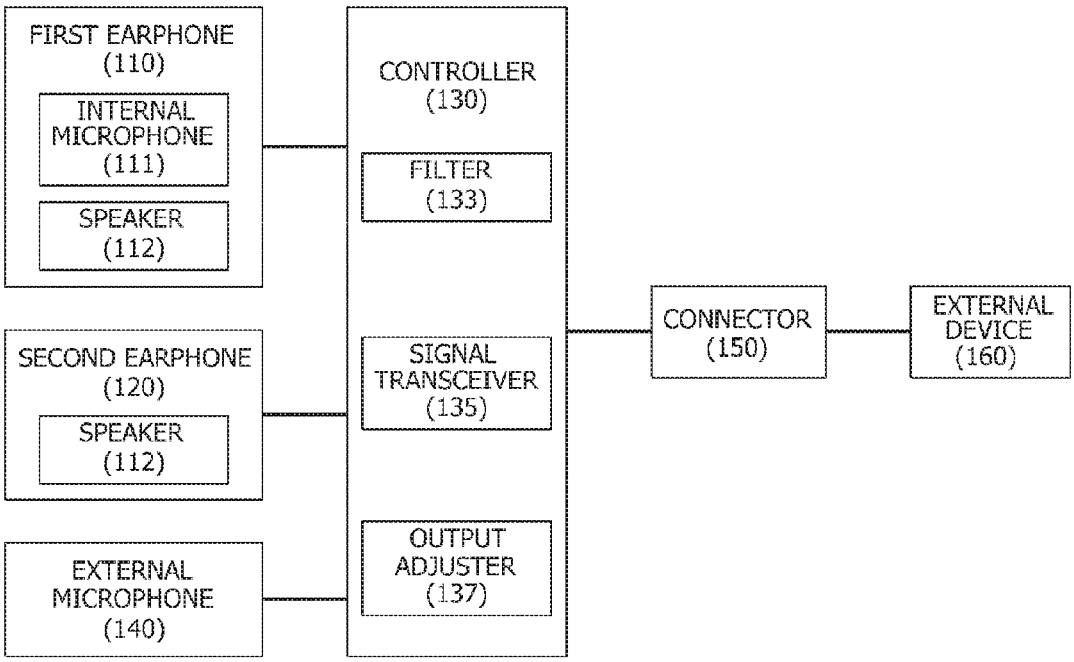
FIG. 2 is a control block diagram of FIG. 1.

A sound filtering system according to one embodiment of the present invention is illustrated in FIGS. 1 and 2.

As illustrated in the above drawings, the sound filtering system according to one embodiment of the present invention includes an earset 100 and an external device 160. Here, the external device 160 refers to a smart phone, another transmission and reception terminal, or the like.

The earset 100 includes a first earphone 110, a second earphone 120, an external microphone 140, and a controller 130. In addition, the earset 100 may further include a connector 150 connected to the external device 160.

An earphone 100 includes the first earphone 110 and the second earphone 120 which are respectively worn on a user's both ears.

The first earphone 110 and the second earphone 120 are respectively worn on the user's ears, an internal microphone 111 and a speaker 112 are provided in the first earphone 110, and only a speaker 122 is provided in the second earphone 120.

The internal microphone 111 embedded in the first earphone 110 receives a first sound transferred from the user's mouth through an external auditory meatus via an Eustachian tube, converts the first sound into a first sound signal, and then transmits the first sound signal to the controller 130.

The speakers 112 and 122 respectively embedded in the first earphone 110 and the second earphone 120 output a sound signal provided from the external device 160 as a sound to provide the sound to the external auditory meatus of the user.

In addition, an outside of the earphone 100 may suppress a noise generated by hitting a wind sound to the earphone 100, and may be formed of silicone in order to waterproof the earphone 100.

The external microphone 140 is provided outside the earphone 100 to be exposed to the outside, more preferably, is disposed close to the user's mouth, receives a second sound which is directly collected from the user's mouth, converts the second sound into a second sound signal, and then transmits the second sound signal to the controller 130. Here, the second sound signal which is transmitted to the controller 130 through the external microphone 140 is transferred at the same phase as that of the first sound signal which is transmitted to the controller 130 through the internal microphone 111. In addition, in the present embodiment, although a single external microphone 140 is illustrated as being provided, but the present invention is not limited thereto, and two or more external microphones 140 may be provided.

The controller 130 is provided in the earset 100 to control overall the earset 100, controls the internal microphone 111, which converts the first sound transferred through the external auditory meatus into the first sound signal, and the external microphone 140, which receives the second sound which is directly collected from the user's mouth and converts the second sound into the second sound signal, and controls the speakers 112 and 122, which receive the sound signal provided from the external device 160 and output the sound signal as a sound.

The controller 130 includes a filter 133 and a signal transceiver 135.

The filter 133 filters and removes a noise of the second sound signal, for example, a noise introduced with the sound which is directly collected from the user's mouth through the external microphone 140, based on the first sound signal, and then generates a third sound signal with respect to a real voice of the user.

Since the first sound signal and the second sound signal have the same phase, the filter 133 determines whether a waveform of the second sound signal is abnormal based on a waveform of the first sound signal. When it is determined that an abnormal waveform is generated in the second sound signal, the filter 133 generates a waveform opposite the abnormal waveform of the second sound signal to offset to the abnormal waveform of the second sound signal, and thus removes the noise of the second sound signal.

Meanwhile, while the filter 133 filters and removes only a noise of the second sound signal converted through the external microphone 140, and then transmits the second sound signal to the external device 160 via the signal transceiver 135, the filter 133 does not transmit the first sound signal converted through the internal microphone 111 to the external device 160 via the signal transceiver 135 regardless of the filtering.

The signal transceiver 135 transmits the third sound signal with respect to the real voice of the user, which is generated by being filtered by the filter 133, to the external device 160 through the connector 150. In addition, the signal transceiver 135 also serves to receive the sound signal provided from the external device 160 and transmit the sound signal to the speakers 112 and 122.

Here, although not illustrated, a wireless communication module may be provided as the signal transceiver 135, and may transmit the third sound signal to the external device 160 without passing through the connector 150.

Therefore, the controller 130 generates a third sound signal by filtering the noise of the second sound signal based on the first sound signal, and transmits the third sound signal to the external device 160.

Therefore, since the first sound signal converted through the internal microphone 111 is not transferred to the external device 160 and only the third sound signal with respect to the actual voice of the user in which the noise of the second sound signal converted through the external microphone 140 is removed is transmitted to the external device 160, the other party may clearly recognize the voice of the user even in a noisy environment, the user may call the other party with a good sound quality, and the sound filtering system may also be used in voice commands or voice translation.

In addition, the controller 130 may further include an output adjuster 137 which adjusts an output of the third sound signal. The output adjuster 137 adjusts the output of the third sound signal output from the filter 133 to a predetermined size, and then transmits the adjusted third sound signal to the signal transceiver 135.

In such a configuration, a process of calling the other party using the sound filtering system according to one embodiment of the present invention will be described as follows.

First, only a first sound into which an ambient noise transferred from a user's mouth through an external auditory meatus via an Eustachian tube is not introduced, for example, a voice of the user, is converted into a first sound signal through the internal microphone 111, a second sound into which the ambient noise provided from the user's mouth is introduced is converted into a second sound signal through the external microphone 140, and the filter 133 of the controller 130 then generates a third sound signal in which the noise introduced into the second sound signal through the external microphone 140 is removed based on the first sound signal provided from the internal microphone 111, for example, a third sound signal close to a real voice of the user.

Next, the third sound signal generated in the filter 133 is transmitted to the external device 160 by the signal transceiver 135.

Therefore, the user may smoothly call the other party due to the third sound signal transmitted from the signal transceiver 135.

Figure 3:
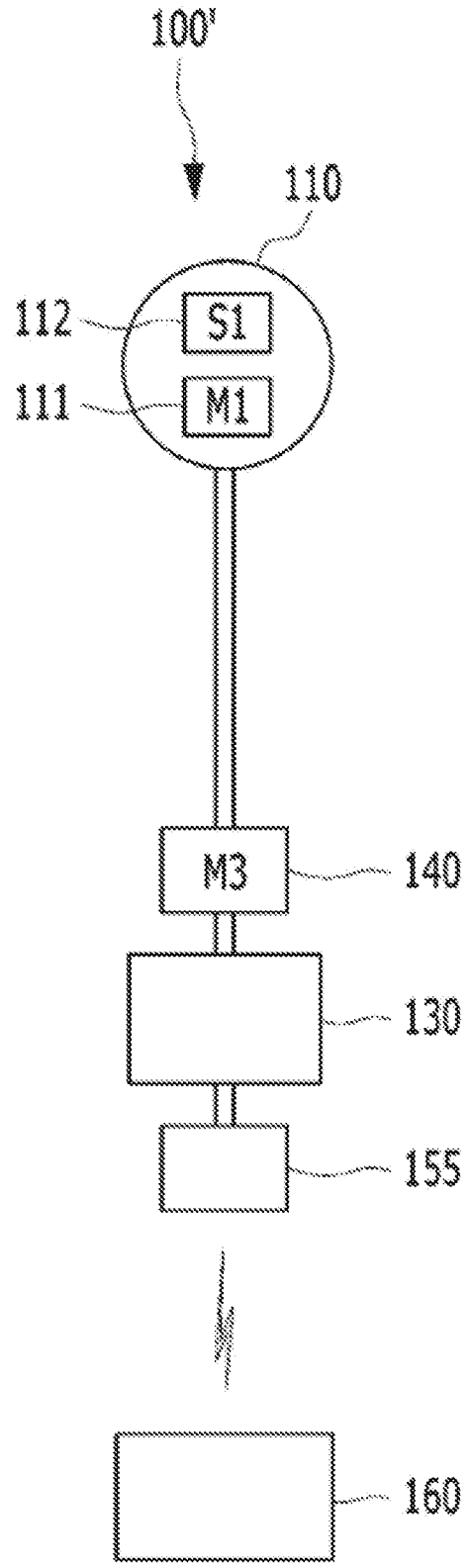
FIG. 3 is a schematic diagram of a sound filtering system according to another embodiment of the present invention.
Figure 4:
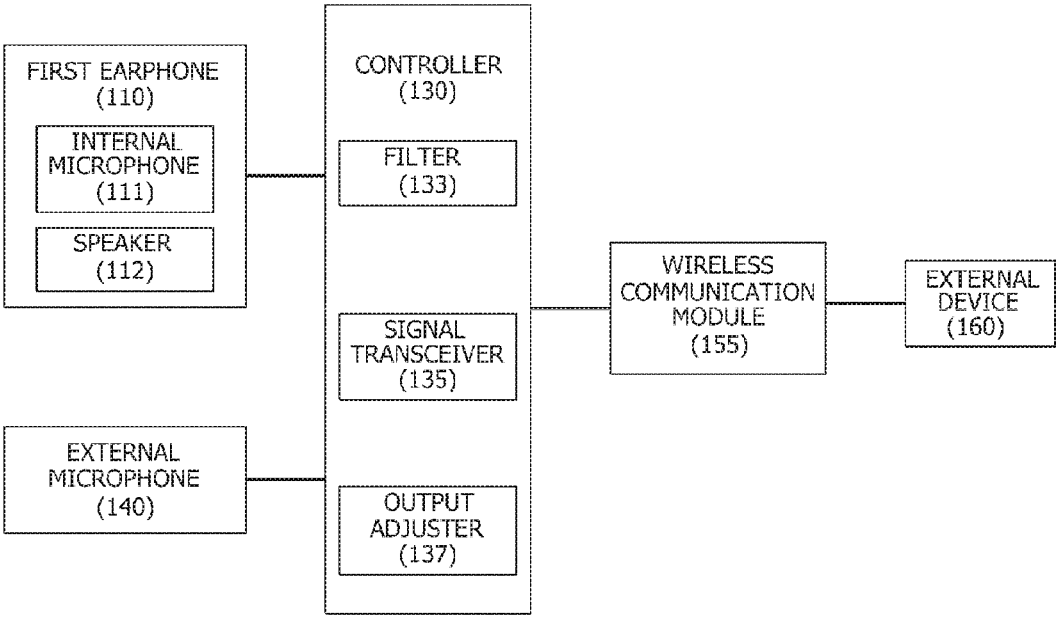
FIG. 4 is a control block diagram of FIG. 3.

Meanwhile, a schematic diagram of a sound filtering system according to another embodiment of the present invention is illustrated in FIGS. 3 and 4. As illustrated in the above drawings, in the sound filtering system according to another embodiment of the present invention, unlike the above-described embodiment, an earset 100' includes only a single first earphone 110 to be worn on a user's ear, and has a configuration of transmitting and receiving signals with an external device 160 through a wireless communication module 155 in a wireless manner.

Therefore, the third sound signal generated in the filter 133 by removing the noise of the second sound signal based on the first sound signal is transmitted from the signal transceiver 135 to the external device 160 through the wireless communication module 155, and thus an earset wearer may smoothly call the other party.

In this way, according to the present invention, since the introduced ambient noise of the sounds which are directly collected from the user's mouth is filtered and removed based on the sound transferred from the user's mouth through the ears thereof and only the filtered voice of the user is then provided to the other party, the other party may clearly recognize the voice of the user even in a noisy environment, the user may call the other party with a good sound quality, and the sound filtering system may also be used in voice commands or voice translation.

Meanwhile, in the above-described embodiments, although the controllers are illustrated as being provided in the earsets, but the present invention is not limited thereto, and the controllers may be provided in external devices. In this case, an application with respect to a function of each of components of the controller is installed in the external device, and a third sound signal in which a noise of the second sound signal is filtered and removed based on the first sound signal transmitted from the earset may also be generated in the application of the external device.

In addition, although the earset applied to the sound filtering system according to the present invention is illustrated in a state in which an internal microphone and a speaker are provided in only any of a pair of earphones which are worn on a user's both ears and only a speaker is provided in the other earphone, but the present invention is not limited thereto, and the internal microphone and the speaker may be provided in the pair of earphones, respectively.

What is claimed is:

1. A sound filtering system comprising:

an internal microphone provided inside an earphone worn on a user's ear, and configured to receive a first sound transferred from the user's mouth through an external auditory meatus via an Eustachian tube and convert the first sound into a first sound signal;

at least one external microphone provided outside the earphone, and configured to receive a second sound provided from the user's mouth and convert the second sound into a second sound signal; and a controller configured to filter a noise of the second sound signal based on the first sound signal, remove the noise, and generate a third sound signal, wherein the first sound signal and the second sound signal have the same phase, wherein the controller includes a filter, wherein the filter determines whether a waveform of the second sound signal is abnormal based on a waveform of the first sound signal, wherein when the filter is determined an abnormal waveform is generated in the second sound signal, the filter generates a waveform opposite the abnormal waveform of the second sound signal to offset to the abnormal waveform of the second sound signal, and thus removes the noise of the second sound signal.

2. The system of claim 1, wherein the controller is provided in an earset including the internal microphone and the at least one external microphone, or in an external device.

3. The system of claim 1, further comprising an output adjuster configured to adjust an output of the third sound signal.

4. The system of claim 1, wherein the earphone includes a speaker configured to output a sound signal provided from the external device as a sound and provide the sound to the external auditory meatus of the user.

* * * * *